US010791808B2

(12) United States Patent
Kane

(10) Patent No.: US 10,791,808 B2
(45) Date of Patent: Oct. 6, 2020

(54) COMPACT WALLET

(71) Applicant: Daniel Kane, Agoura Hills, CA (US)

(72) Inventor: Daniel Kane, Agoura Hills, CA (US)

( * ) Notice: Subject to any disclaimer, the term of this patent is extended or adjusted under 35 U.S.C. 154(b) by 0 days.

(21) Appl. No.: 15/421,596

(22) Filed: Feb. 1, 2017

(65) Prior Publication Data

US 2017/0135452 A1 May 18, 2017

Related U.S. Application Data

(63) Continuation-in-part of application No. 14/706,019, filed on May 7, 2015, now abandoned.

(51) Int. Cl.

| | |
|---|---|
| ***A45C 1/06*** | (2006.01) |
| ***A45C 11/18*** | (2006.01) |
| ***A45C 13/18*** | (2006.01) |
| ***A45C 1/08*** | (2006.01) |

(52) U.S. Cl.

CPC ..... *A45C 1/06* (2013.01); *A45C 1/08* (2013.01); *A45C 11/182* (2013.01); *A45C 13/185* (2013.01); *A45C 2001/062* (2013.01); *A45C 2001/065* (2013.01); *A45C 2001/083* (2013.01); *A45C 2011/186* (2013.01)

(58) Field of Classification Search

CPC ..... A45C 1/06; A45C 1/08; A45C 11/182; A45C 13/185; A45C 2001/062; A45C 2001/065; A45C 2001/083; A45C 2011/186

See application file for complete search history.

(56) References Cited

U.S. PATENT DOCUMENTS

| | | | | |
|---|---|---|---|---|
| 11,348 A * | 7/1854 | Andrews | G09F 3/14 | 40/665 |
| 1,525,745 A * | 2/1925 | Keefer | B65D 5/6673 | 206/256 |
| 2,322,461 A * | 6/1943 | Mariano | A44C 5/00 | 40/118 |
| 4,477,928 A * | 10/1984 | Graff | A41F 9/025 | 2/221 |
| 5,038,985 A * | 8/1991 | Chapin | A47F 7/143 | 224/669 |
| 5,077,869 A | 1/1992 | Haase | | |
| 5,944,080 A * | 8/1999 | Podwika | A45C 11/182 | 150/137 |
| 5,952,637 A * | 9/1999 | Strunk | A63F 3/0023 | 16/225 |
| 6,094,747 A * | 8/2000 | Malick | A41D 13/087 | 2/159 |
| 7,334,616 B2 | 2/2008 | Kaminski | | |

(Continued)

OTHER PUBLICATIONS

The Ridge Wallet, from U.S. Appl. No. 14/706,019.*

(Continued)

*Primary Examiner* — Tri M Mai

(74) *Attorney, Agent, or Firm* — Patent Service Associates, Inc.; Lyman Smith

(57) ABSTRACT

The present invention is a compact wallet designed to present a minimal silhouette in a shirt, pants or purse pocket. Novel features hold the silhouette to the minimal dimensions of a credit card while affording maximal expandability for content storage and accessibility. A novel method makes additional features modularly available.

24 Claims, 7 Drawing Sheets

(56) References Cited

U.S. PATENT DOCUMENTS

| | | | | |
|---|---|---|---|---|
| 7,527,081 | B2 * | 5/2009 | Coates | A45C 1/06 150/147 |
| 7,810,683 | B2 | 10/2010 | Chan | |
| 8,381,360 | B2 * | 2/2013 | Preston-Hall | A45C 1/08 150/900 |
| D716,043 | S * | 10/2014 | Wilk | D3/247 |
| 9,125,464 | B2 * | 9/2015 | Minn | A45C 1/06 |
| 9,314,074 | B2 * | 4/2016 | Johnson | A45C 1/06 |
| 2005/0023157 | A1 | 2/2005 | Logan | |
| 2009/0094795 | A1 | 4/2009 | Lazarus | |
| 2009/0211062 | A1 | 8/2009 | Preston-Hall | |
| 2010/0139049 | A1 | 6/2010 | Glickfield | |
| 2012/0180917 | A1 | 7/2012 | Armstrong | |
| 2013/0276943 | A1 | 10/2013 | Minn | |
| 2014/0233181 | A1 | 8/2014 | Harms | |
| 2015/0083289 | A1 | 3/2015 | Johnson | |

OTHER PUBLICATIONS

'Ridge Wallet Review' (Kickstarter) Jul. 21, 2014, Retrieved from the Internet on Jul. 8, 2016, URL: <http://kickstarter.reviews/ridge-wallet-2/>.

'3m Bonding Tapes' (3M) Oct. 30, 2014. Retrieved from the Internet on Jul. 11, 2016, URL:<https://web.archive.org/web/20141030183241/http://www.ameyagroup.co.in/pdf/product%.

* cited by examiner

COMPACT WALLET

CROSS-REFERENCE TO RELATED APPLICATIONS

This is a Continuation-In-Part Application claiming priority to parent U.S. Non-Provisional patent application Ser. No. 14/706,019, filed May 7, 2015, and to International Application PCT/US16/31472, filed May 9, 2016, both of which are incorporated herein in entirety.

FIELD OF THE INVENTION

This invention relates to billfold wallets, and more particularly to low-profile wallets for credit cards.

BACKGROUND OF THE INVENTION

Who among us would not prefer a wallet minimally-sized to just the stack of credit cards carried in the typical bi- or tri-fold leather wallet? Such a minimalist wallet could be easily slipped into a shirt pocket, or present a slim profile in a pants pocket or purse. Even with money clipped to it, the bulk of such a wallet would be less than that of the fold-over-envelope-type-wallet traditionally used to carry cards, money and identification. Such a traditional wallet, with its internal sleeves, compartments, and windows, not to mention contents, can bulge uncomfortably or telltale-like from clothing, or inconveniently in a handbag, while giving little protection from moisture, bending or electronic snooping.

In the lifestyle of today, purchases are made more and more with credit or debit cards or through electronic wallets, such as Apple Pay™ or Google Wallet™. Carrying cash, except for an emergency bill or two, has increasingly become both unnecessary and inconvenient in consideration of the nuisance in making change and risk of loss through theft or carelessness. The traditional wallet, initially designed to carry cash in bills, and sometimes coins and checks also, is correspondingly evolving into obsolescence in view of the convenience and record-keeping benefit of credit/debit cards. The bare essentials today are a charge card of some type and an item of identification, both, serendipitously, of generally the same size.

Money clips are common in the art and some money clips also made accommodation for credit cards. The clip, typically of hairpin-like configuration, has protrusion which can snag in a pocket of clothing or purse. Other known devices sandwich cards and/or money between bookend plates bound with elastic strapping. The strapping allows for an expandable interior volume while providing compression to grip the contents. The profile of the plates is generally larger than that of the contents, the out-sizing necessary to provide structure for either guiding the strapping or for fixtures to terminate the strapping. In most cases, the running length of the strapping is limited by the distance between fixture locations on the plates, which limits the expansion capability and, therefore, the capacity for contents. In other cases, it becomes difficult to view the stored contents without moving them all. In other cases, selectively withdrawing of just one of the contents, particularly with a presentation of the shorter edge, is frustrated by the compaction applied. In other cases, replacement of the straps when worn or stretched out is discouraged by assembly design. In other cases, the plates are of insufficient rigidity to protect the contents from bending.

The unfulfilled need is for a compact wallet which would be minimally dimensioned to the prototypical credit card profile. Such a compact wallet would be void of any potentially snagging structural appendages while optimizing volume expansion and view-ability of contents.

SUMMARY OF THE INVENTION

The present invention utilizes bookend plates resiliently bound with an encircling elastic band to contain one or more credit card-sized objects in a wallet configuration. A novel feature maximizes the expansion of interior volume by allowing the strap to expand along a maximum length afforded by a longitudinal dimension of the wallet while avoiding anchor points which would effectively shorten the length. Another novel feature achieves minimal sizing of the plates by channeling the strap with interior means rather than by means of profile extensions. Yet another novel feature achieves easy access to, and viewing of, the contents through a cut-away feature which allows the contents to be partially pushed up where a fulcrum is provided for pinching the plates together and fanning out the contents.

It is, therefore, an object of the invention to provide a compact wallet substantially no larger than a credit card. It is a further object to maximize expandability of the wallet to accommodate multiple objects of substantially the same size. It is a further object to protect the contents of the wallet from damage or loss by open-ended drop through. It is a further object to facilitate selection of any one object from the bound group. It is a further object to accommodate folded currency handily on the outside of the wallet. It is a further object to present essentially smooth contours for snag-free passage into and out of pockets of clothing or bags. It is a further object to provide means and method for changing out elastic bounding bands. It is a further object to provide a method for making a compact wallet with different features attached thereto which can be modularly exchanged.

These objects, and others to become hereinafter apparent, are embodied in a compact wallet comprising, in a first element, at least two rigid plates interposed to sandwich card-like contents there between, each rigid plate having a longitudinal extent. A second element is at least one encircling elastic band interposed with the at least two rigid plates, over the longitudinal extents thereof, to bias them inwardly and securely hold the card-like contents while providing elastic volume between the plates for adding additional contents. A third element is a channeling means configured to minimize the profile of the wallet and hold position of the at least one encircling elastic band with respect to each rigid plate. The channeling means additionally allows freedom for the dynamic extension and contraction of the band over the entire running length of the band. With such means and in such manner, card-like contents may be carried with minimal silhouette on or with a person while allowing expandable capacity and ready access to individual contents from between the at least two rigid plates.

In a preferred embodiment, the channeling means is a longitudinal groove in a first lamina of a laminate construction of each rigid plate. The groove slidingly receives one part of the at least one encircling elastic band. In one instance of the preferred embodiment, a second lamina of the laminate construction of each rigid plate is removably attached to the first lamina to hold the at least one elastic band in capture and provide a smooth surface for glide purposes. In another instance, the second lamina is attached to the first lamina by screws.

In an alternate embodiment, a method of making a modular compact wallet comprises the steps of providing a compact wallet having at least two rigid plates each having a groove, at least one groove additionally having a recess, and at least one encircling elastic band interposed in the grooves to bias the plates inwardly; providing a first auxiliary feature having a tang; removably inserting the tang of the first auxiliary feature into the recess to attach the first auxiliary feature to an outside surface of at least one of the rigid plates; selectively removing the first auxiliary feature; selectively providing at least a second auxiliary feature having a tang; and removably inserting the tang of the second auxiliary feature into the recess to attach the second auxiliary feature to the outside surface.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION OF THE PREFERRED EMBODIMENT

Figure 1:
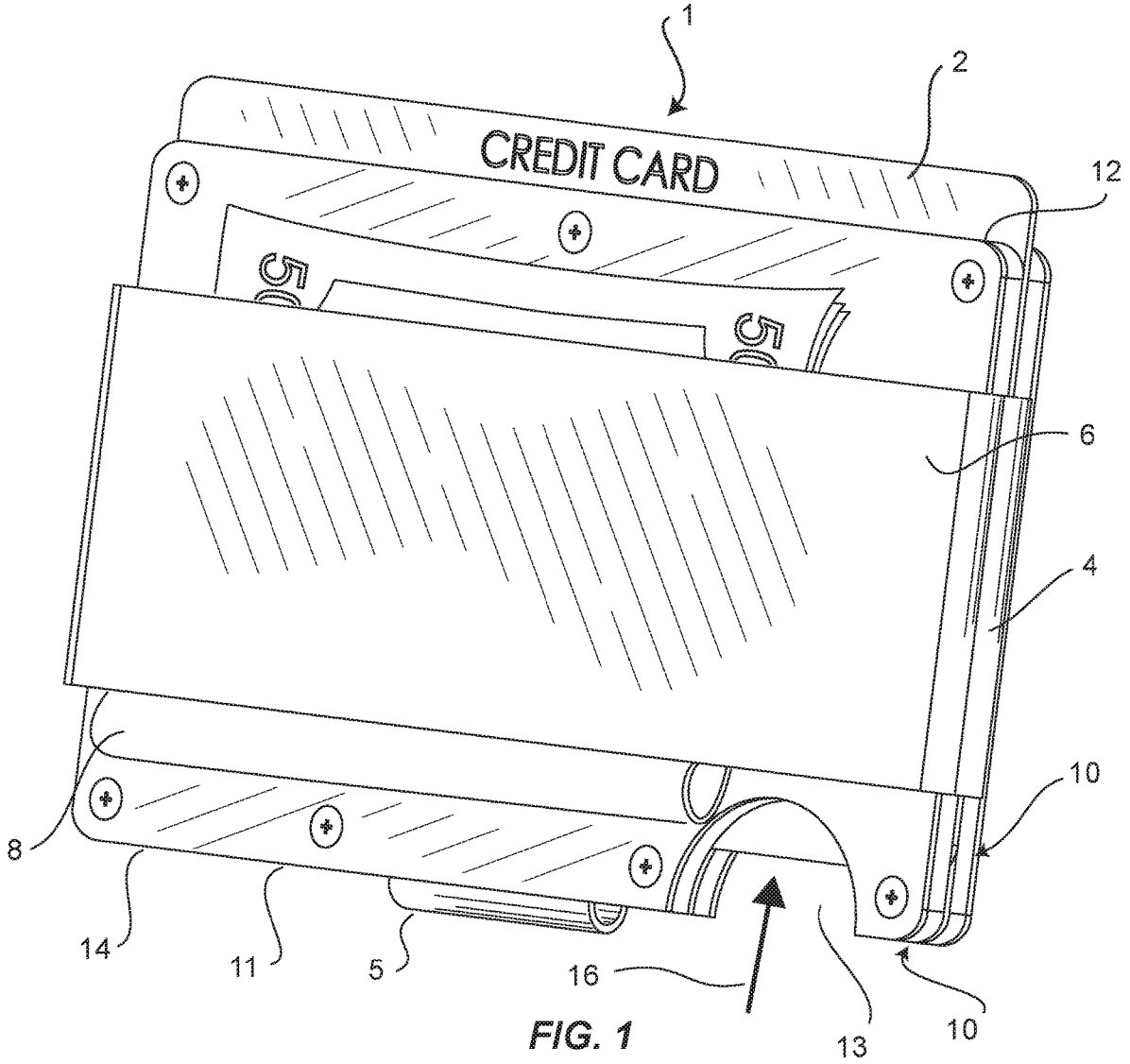
FIG. 1 is a perspective view of the compact wallet of the present invention showing currency banded to the outside thereof and a credit card extended into view by means of a finger notch.
Figure 2:
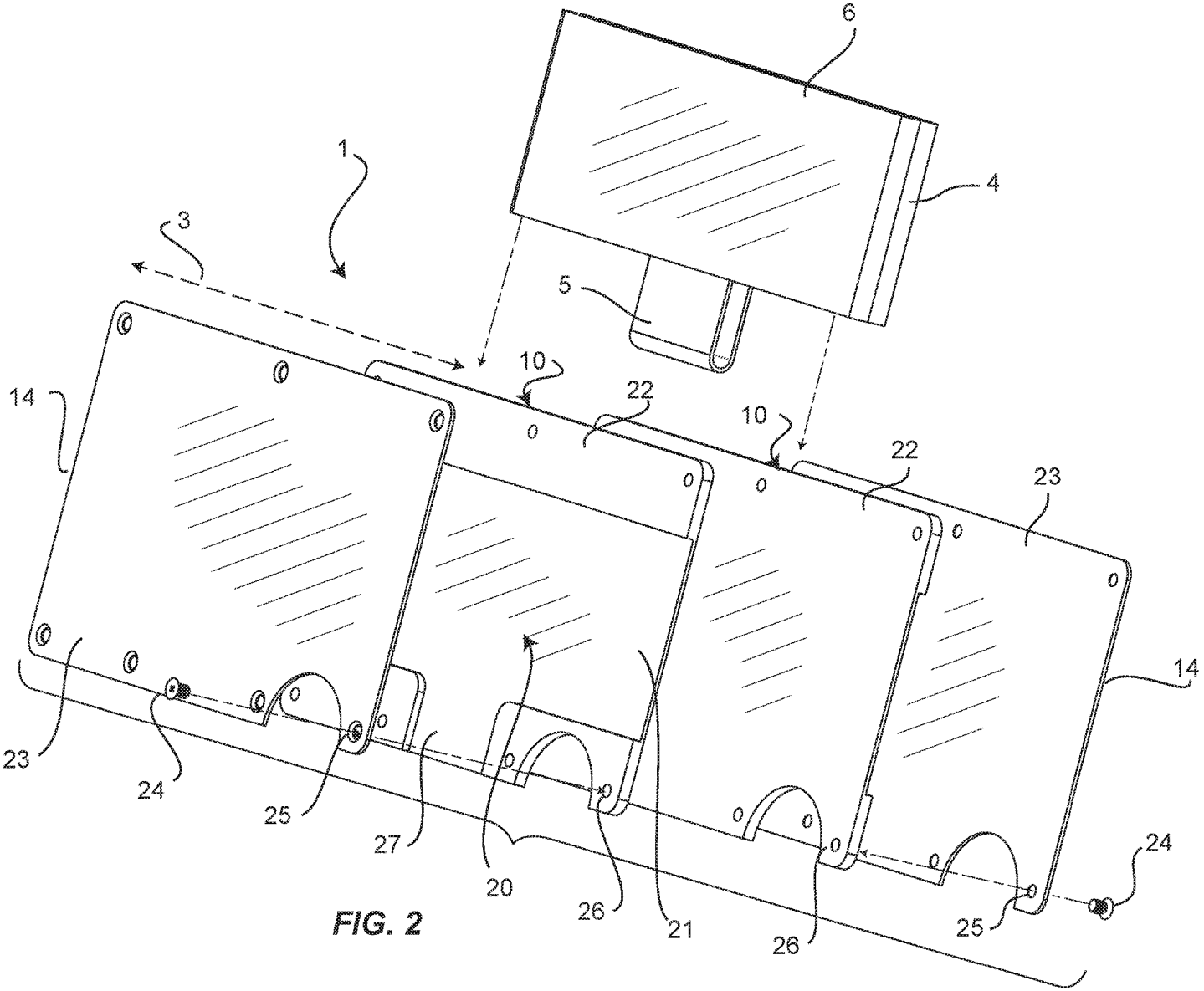
FIG. 2 is an exploded view of the compact wallet.
Figure 4:
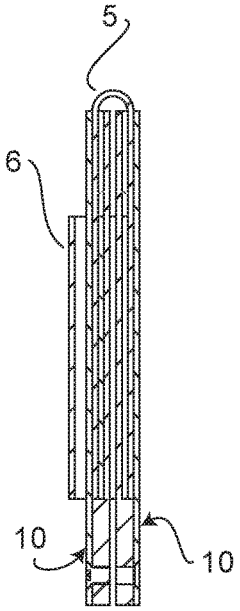
FIG. 4 is a section view taken along the lines 4-4 of FIG. 3.
Figure 3:
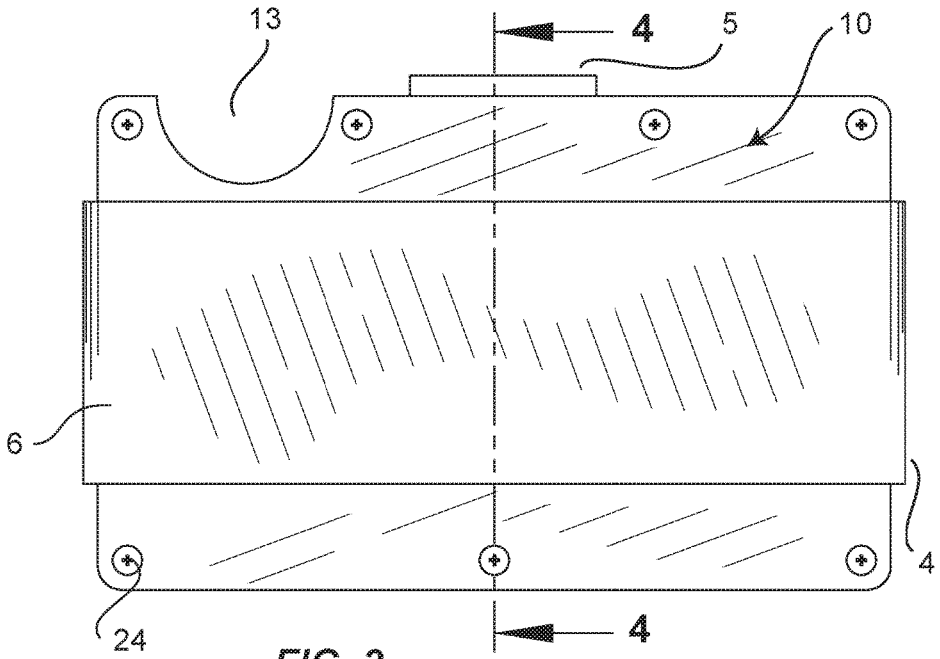
FIG. 3 is a plan view of the compact wallet.
Figure 5:
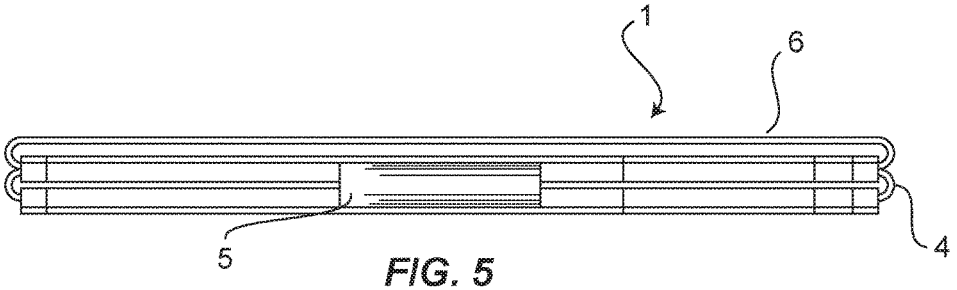
FIG. 5 is a top view of the compact wallet.
Figure 6:
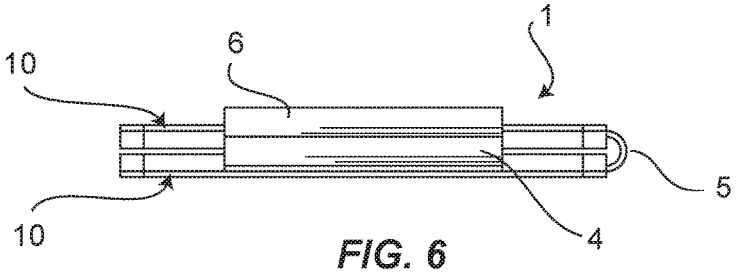
FIG. 6 is a right-side view of the compact wallet.
Figure 7:
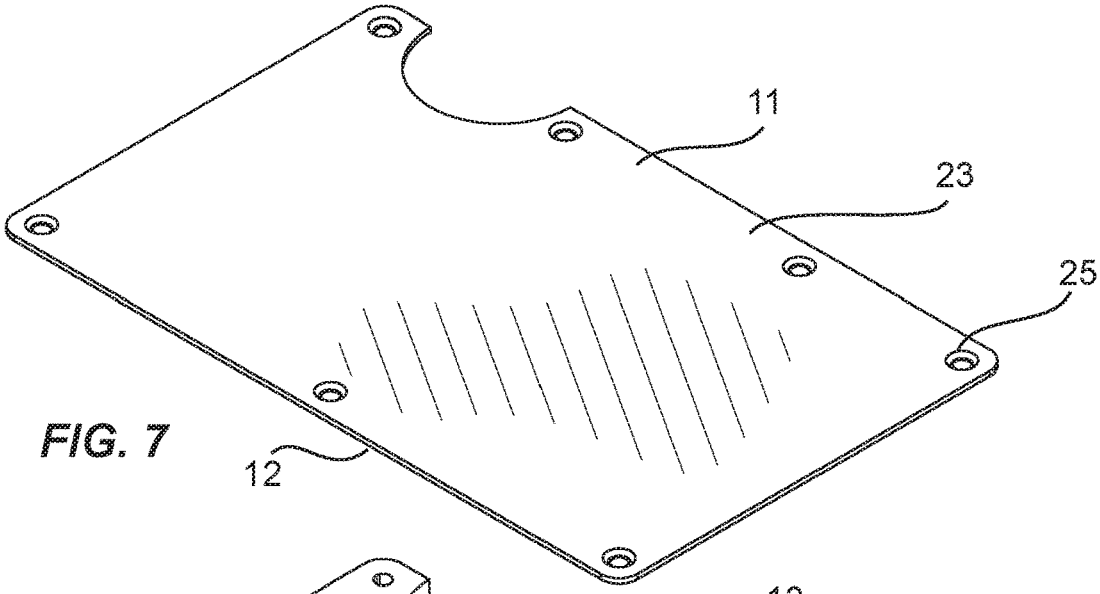
FIG. 7 is a perspective view of a second lamina of a laminate construction of one of the rigid plates.

Referring to FIGS. 1 and 2, a compact wallet 1 is comprised of at least two rigid plates 10, serving as "bookends" as it were, with one or more card-like contents 2 sandwiched between them. The sandwiched composite is bound by at least one encircling elastic band 4. The encircling elastic band 4 holds the card-like contents 2 securely by means of compression, while also expanding elastically to open space between the rigid plates 10. The added volume of the space provides capacity for additional contents. The rigid plates 10 are sized to the dimensions of a standard credit card and the resulting perimeter defines a profile 14. A channeling means 20 prevents the encircling elastic band 4 from adding more than negligible breadth to profile 14. This profile minimization is accomplished by locating the channeling means 20 internally to the rigid plates 10. In other words, no structures projecting from the profile 14 are needed to fixture the encircling band 4, as in the case of prior art.

Referring to FIGS. 2 to 9, the channeling means 20 of the preferred embodiment is a longitudinal groove 21 spanning a longitudinal extent 3 of each rigid plate 10. The longitudinal groove 21 is of such ample dimension as to receive a corresponding part of the encircling elastic band 4 and allow it to slidingly expand and contract freely while holding position there within. In this way, the full running length of the band can be exercised for expansion while contraction is rendered responsive. The result is a maximally achievable opening between the plates whereby filling volume is optimized.

In one preferred embodiment, the longitudinal groove 21 traverses a first lamina 22 of a laminate construction of each rigid plate 10. The first lamina 22 is capped with a second lamina 23 to capture one portion of the encircling elastic band 4 and complete the channeling means 20. The second lamina 23 is preferably attached removably to the first lamina 22 to enable the encircling elastic band 4 to be changed out at the end of its service life. In a particular preferred embodiment, the attachment is made by flat-headed screws 24 threaded into threaded holes 26 in the first lamina 22 through countersunk holes 25 in the second lamina. The flat-heading and counter-sinking of the screws provide a smooth outer surface to the compact wallet 1, thereby permitting snag-free glide into pockets or other containment vessels. In an alternate embodiment, the attachment mechanism may include appropriately placed pressure sensitive adhesive strips (not shown). Other attachment means, known in the art, are also contemplated as within scope.

Figure 10:
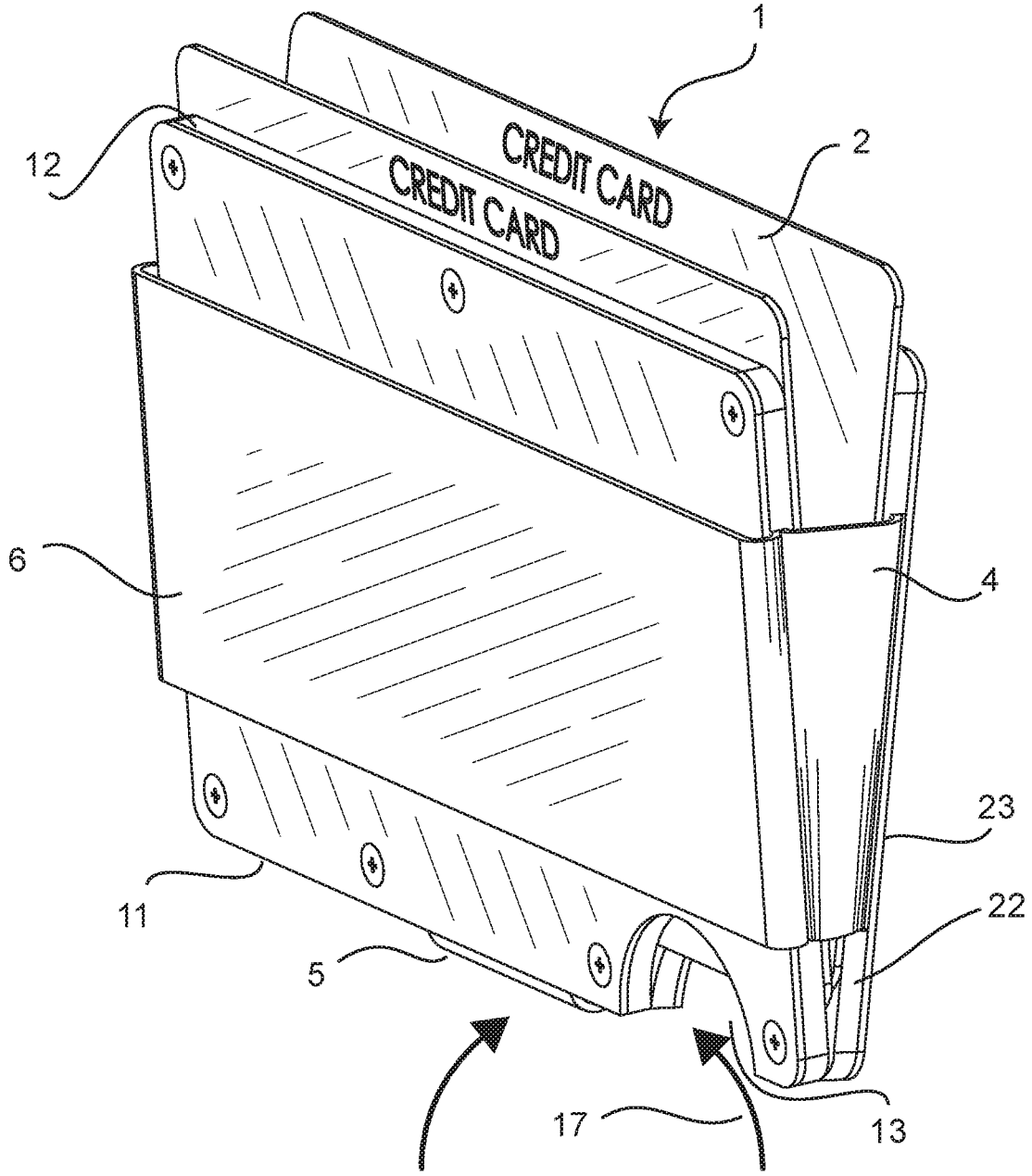
FIG. 10 is a perspective view of a fanned open compact wallet.

In one preferred embodiment shown in FIGS. 1 and 10, a finger notch 13 is provided in the periphery at a proximal end 11 of each rigid plate 10 such that the notches of facing plates are aligned. To accomplish the alignment, each plate must be configured in a mirror image of the other. The finger notches 13 expose an edge of the card like contents 2. Using a finger in the finger notch, the card-like contents 2 can be urged upwardly in a lifting maneuver 16 by pressing against the exposed edge to elevate the card-like contents above distal ends 12 of the rigid plates 10. The lifting maneuver 16 makes the card-line contents 2 available for inspection and selection, which would otherwise be difficult tasks when masked by the plates. The display of contents can be further enhanced by a pinching maneuver 17, which is accomplished by pinching the proximal ends 11 together about the fulcrum of the exposed edge of the contents rendered offset from the proximal ends 11 by the preceding maneuver. The pinching maneuver 17 fans open the distal ends 12 and facilitates separation of the card-like contents for further inspection and ease of selection.

Figure 8:
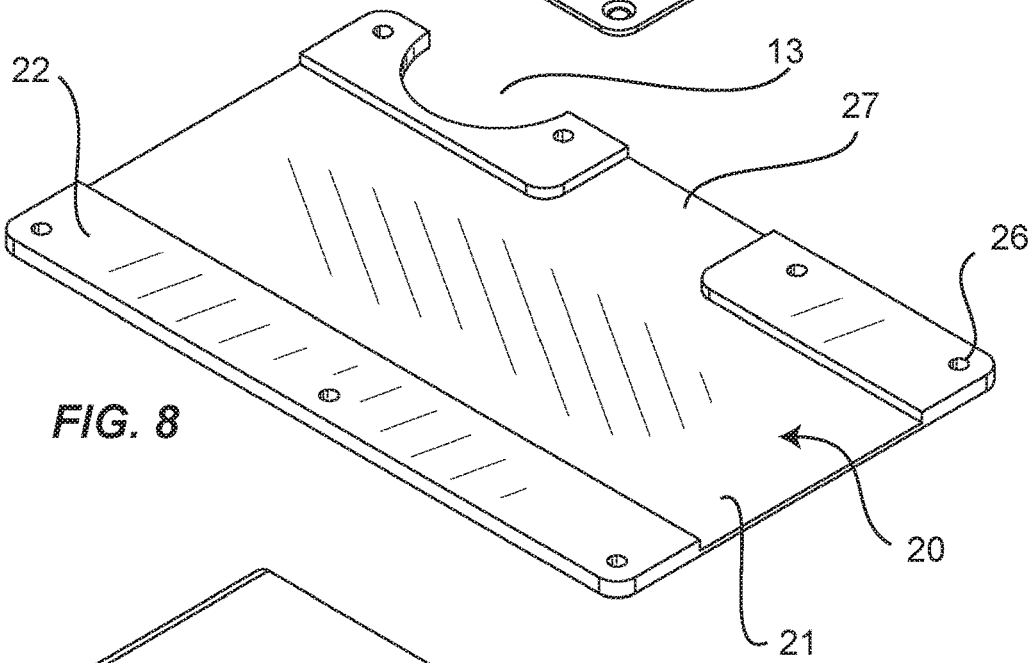
FIG. 8 is a perspective view of a first lamina of the laminate construction showing a groove for channeling an encircling elastic band.
Figure 9:
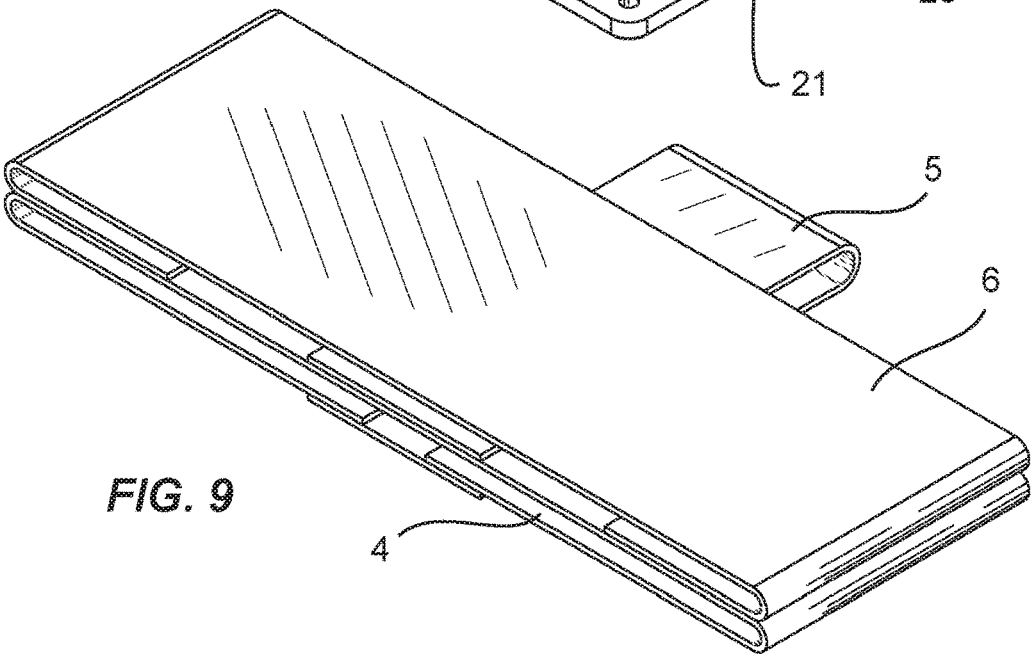
FIG. 9 is a perspective view of the elastic band showing first and second appendant straps.

In one preferred embodiment, as shown in FIGS. 3-6 and 9, a first elastic strap 5 is positioned over the proximal ends 11 of the rigid plates 10. The first elastic strap 5 registers the card like contents to the proximal ends 11 and prevents them from slipping beyond the ends when expansion takes place. Preferably, the first elastic strap 5 is attached to the encircling elastic band 4 by sewing, or bonding, by access through the transverse groove 27 (FIGS. 2 and 8). Alternatively, the first elastic strap 5 is attached to each rigid plate 10 by any known means. In one preferred embodiment, a second elastic strap 6 is positioned over the outside surface of one of the rigid plates 10 to strap thereon currency 8 (FIG. 1), or additional card-like contents 2. Preferably, the second elastic strap 6 is attached to the encircling elastic band 4 by sewing, or bonding, by access through the longitudinal groove 21. Alternatively, the second elastic strap 6 is attached to the rigid plate 10 of its intimacy by any known means.

Figure 11:
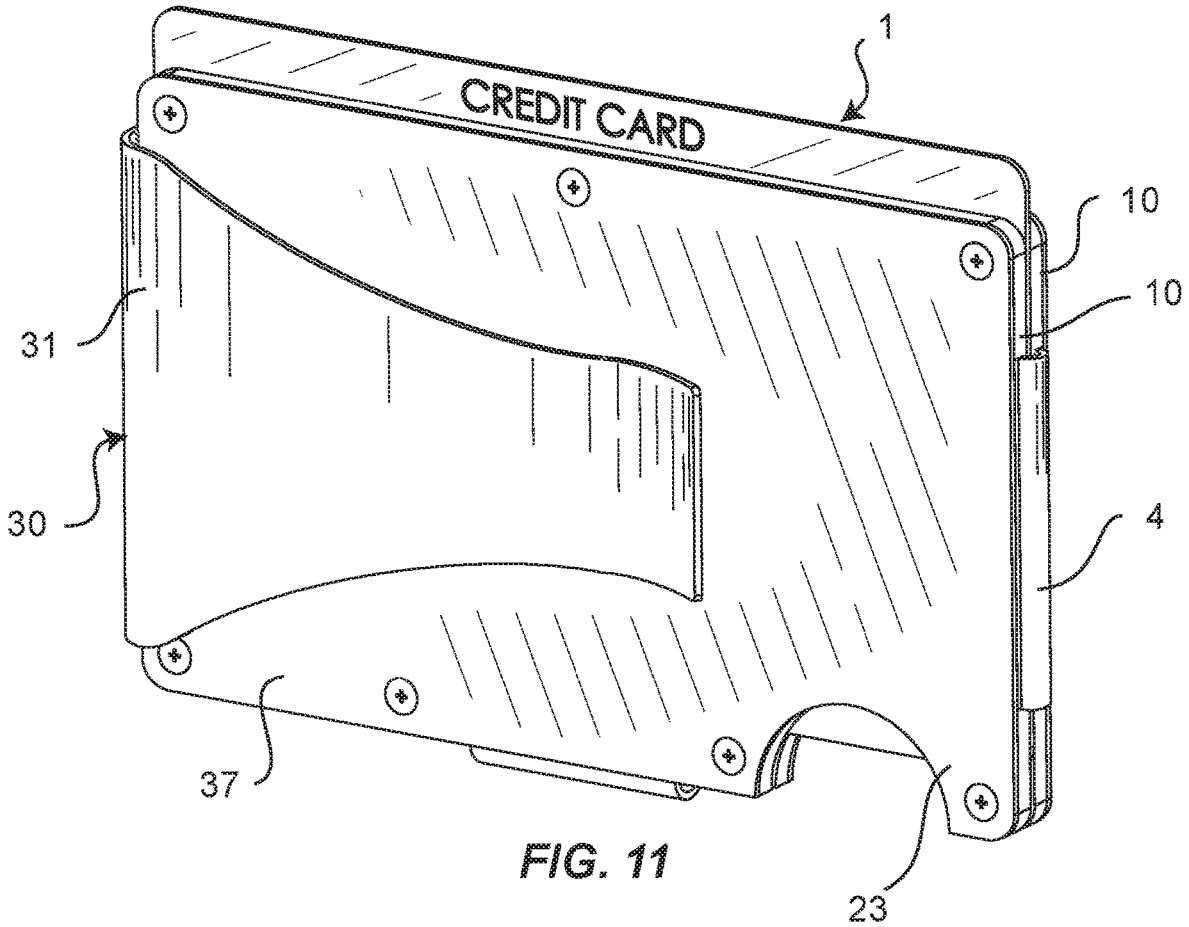
FIG. 11 is a perspective view of the compact wallet with a money clip attached.
Figure 12:
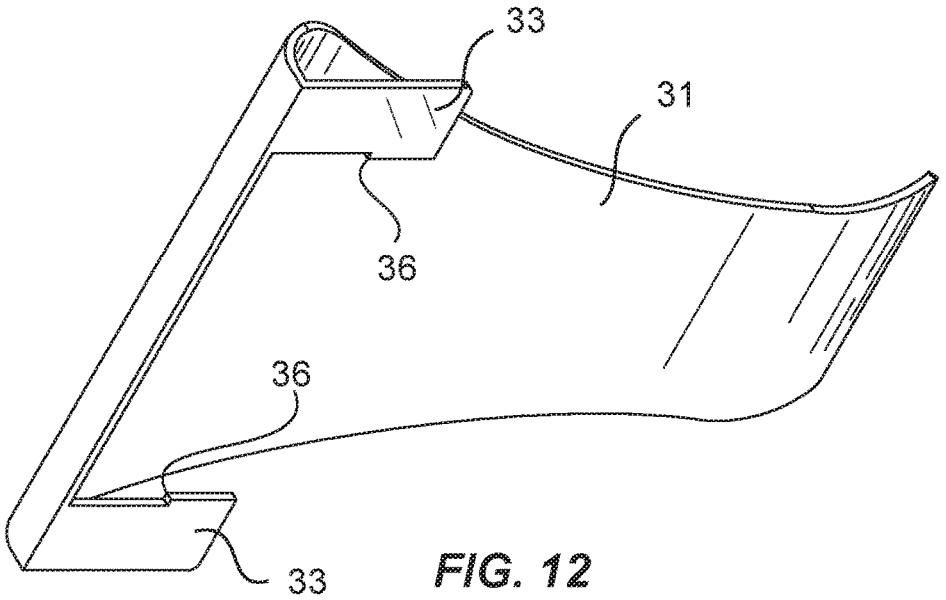
FIG. 12 is a perspective view of the money clip.
Figure 13:
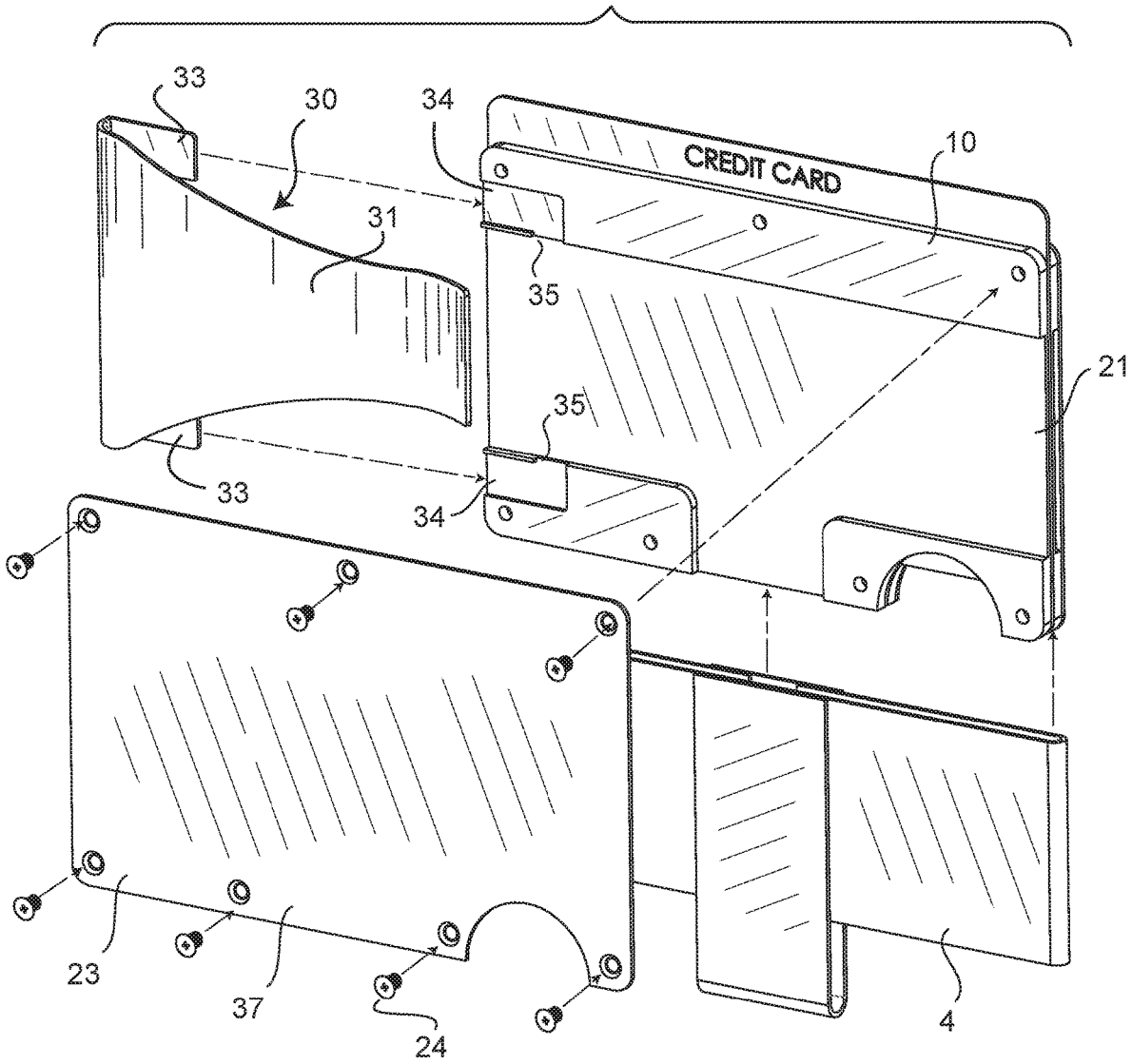
FIG. 13 is an exploded view of the compact wallet with money clip.

In one alternative embodiment, shown in FIGS. 11-13, an auxiliary feature 30 is added to at least one of the rigid plates 10 to occupy a position on an outside surface 37 thereof. Preferably, the auxiliary feature 30 is a money clip 31. Alternatively, the auxiliary feature 30 may be a windowed envelope 32 (not shown). The windowed envelope 32 may be configured to receive a driver's license, a passport card, a military ID, a Global Entry card, or any other card-like content 2 to be displayed exteriorly to the compact wallet 1 by means of a transparent window. The money clip 31 and the windowed envelope 32, while exemplifying the concept, are not otherwise considered to be scope-limiting for the auxiliary feature 30.

The auxiliary feature 30 is removably attached to at least one of the rigid plates 10 by means of a tang 33 inserted into a recess 34 in the groove 21 outboard of the elastic band 4. The outboard positioning prevents interference with the free operation of the elastic band. In a particularity, the recess 34 has an undercut 35 and the tang 33 has a hook 36 (FIG. 12). The hook 36 engages the undercut 35 to prevent inadvertent dislodgement of the auxiliary feature 30 when attached to the compact wallet 1.

In the preferred embodiment, the card-like contents include, but are not limited to, credit cards, a driver's license, ID cards, business cards, affiliation/membership cards, currency bills, loyalty cards, coupons, a calendar, receipts or any paper or card-stock item of a personal or business nature. The rigid plates 10 are either comprised of metal, or otherwise integrate a metalized surface, for radio-frequency identification (RFID) theft protection purposes, as credit cards are increasingly using RFID chips. A substrate can be metalized by electric deposition, by casting, or otherwise by bonding on or taping on a foil. In the preferred embodiment, the first lamina 22 is fabricated from aluminum plate of 2 mm gauge by machining. Alternatively, the first lamina 22 may be 316 stainless steel (SS), or may otherwise be injection molded with high-impact polystyrene (HIPS), acrylonitrile butadiene styrene (ABS) or any resin with stiffness property. The second lamina 23 may be fabricated from similar materials and methods as the first lamina 22, although not necessarily matched thereto. For example, the second lamina 23 may be die-cut from polystyrene sheet stock of 0.7 mm gauge and mated with machined SS from plate stock used for the first lamina 22. The rigid plates 10, and the profile 14 by definition, preferably measure approximately 8.5 cm by 5.4 cm. In the preferred embodiment, the flat-headed screws 24 are comprised of 316 SS; but may also, in the alternative, be made of aluminum or any other metal alloy. The encircling elastic band 4, the first elastic strap 5 and second elastic strap 6 may be any rubber, or rubberized, material configured in a web. In the preferred embodiment, the band and straps are of 3 cm woven elastic fabric, such as that found at the John Howard Company. Alternatively, the bands and straps may differ from each other in materials and sizes.

The compact wallet 1 may be provided at retail in a system configuration with a tool, such as a driver (not shown), to assist with assembly or disassembly. The system may also include an instruction card (not shown), or pamphlet, a spare encircling elastic band 4 or one or more spare flat-headed screws 24. The compact wallet 1 may supplied either assembled or disassembled in the system configuration.

One alternative embodiment is a method of making a modular compact wallet, said method comprising these steps:

i. providing one or more of the embodiments of the compact wallet 1 as discussed above;

ii. providing a first auxiliary feature 30 having at least one tang 33;

iii. inserting, removably, the at least one tang 33 of the first auxiliary feature 30 into at least one recess 34 to make the first auxiliary feature 30 available at an outside face 37 of at least one rigid plate 10;

iv. removing, selectively, the first auxiliary feature 30;

v. providing, selectively, at least a second auxiliary feature 30 having at least one tang 33; and vi. inserting, removeably, the at least one tang 33 of the second auxiliary feature 30 into the at least one recess 34 to make the second auxiliary feature available at the outside face 37 of at least one rigid plate 10.

The beneficial method discussed above provides additional functionality to the compact wallet 1 by modularly positioning, opportunistically, an alternative feature on the outside of the compact wallet, where such a feature would be readily accessible and in view for visual inspection.

It is to be understood that the invention is not limited in its application to the details of construction and to the arrangements of the components set forth in the preceding description or illustrated in the drawings. For example, the channeling means 20 might be a longitudinal bore through each rigid plate 10. Also, it is to be understood that the phraseology and terminology employed herein are for the purpose of the description and should not be regarded as limiting.

What is claimed is:

1. A compact wallet, comprising:

at least two rigid plates interposed to sandwich card-like contents there between, each rigid plate having a longitudinal extent;

at least one encircling elastic band interposed with the at least two rigid plates along longitudinal extents thereof to bias them inwardly and securely hold the card-like contents while providing elastic volume there between for adding or removing contents;

a channeling means configured to minimize the profile of the wallet and hold position of the at least one encircling elastic band with respect to each rigid plate while allowing freedom for the dynamic extension and contraction of the band over the entire running length thereof; and an auxiliary feature removably attached to at least one of the at least two rigid plates, the auxiliary feature having a tang insertable into a recess formed inside the at least two rigid plates, the tang having a hook, the hook extending at an angle to the tang, the hook engaging an undercut of the recess to prevent inadvertent dislodgement of the auxiliary feature from the recess, whereby, card-like contents may be carried with minimal silhouette on or with a person while allowing expandable capacity and ready access to individual contents from between the at least two rigid plates.

2. The compact wallet of claim 1, wherein the channeling means is a longitudinal groove in a first lamina of a laminate construction of each rigid plate, the groove slidingly receiving one part of the at least one encircling elastic band.

3. The compact wallet of claim 2, wherein a second lamina of the laminate construction of each rigid plate is removably attached to the first lamina to hold the at least one elastic band in capture and provide a smooth surface for glide purposes.

4. The compact wallet of claim 3, wherein the second lamina is attached to the first lamina by screws.

5. The compact wallet of claim 3, wherein the second lamina is attached to the first lamina by pressure sensitive adhesive means.

6. The compact wallet of claim 1, wherein each rigid plate is comprised of metal for RFID protection.

7. The compact wallet of claim 1, wherein each rigid plate is metalized for RFID protection.

8. The compact wallet of claim 3, wherein at least one of the first or second lamina of each rigid plate is comprised of metal.

9. The compact wallet of claim 1, further comprising a first elastic strap positioned over the ends of the at least two rigid plates transverse to the longitudinal extents, the positioning functioning to retain the card-like contents from that end.

10. The compact wallet of claim 1, further comprising a second elastic strap positioned over an outside surface of one of the at least two rigid plates to hold additional contents on the outside surface.

11. The compact wallet of claim 1, wherein the card-like contents comprise one or more of a credit card, a driver's license, an ID card, a business card, an affiliation card, a currency bill, a loyalty card, a coupon, a receipt or a personal paper.

12. The compact wallet of claim 1, further comprising aligned finger notches through proximal ends of the rigid plates to expose an edge of the card-like contents for the purpose of pushing the edge to elevate the contents into view through distal ends of the rigid plates, said edge providing a fulcrum to lever the proximal ends together for the purpose of fanning the distal ends apart in display of the contents.

13. The compact wallet of claim 1, wherein the encircling elastic band is comprised of woven elastic fabric.

14. A compact wallet, comprising:

at least two rigid plates interposed to sandwich card-like contents there between, each rigid plate having a groove along a longitudinal extent thereof;

at least one encircling elastic band slidingly interposed in the grooves to bias the at least two rigid plates inwardly and securely hold the card-like contents while providing elastic volume there between for adding or removing contents, the grooves configured to hold position of the at least one encircling elastic band with respect to each rigid plate while allowing freedom for the dynamic extension and contraction of the band over the entire running length thereof; and a recess formed inside at least one of the at least two rigid plates, the recess operable to receive a tang of an auxiliary feature, the recess having an undercut operable to engage a hook of the tang to prevent inadvertent dislodgement of the auxiliary feature from the recess when the auxiliary feature is removably positioned in at least one of the at least two rigid plates, the hook extending at an angle to the tang, whereby, card-like contents may be carried with minimal silhouette on or with a person while allowing expandable capacity and ready access to individual contents from between the at least two rigid plates.

15. The compact wallet of claim 14, wherein the groove is in a first lamina of a laminate construction of each rigid plate, the groove slidingly receiving one part of the at least one encircling elastic band.

16. The compact wallet of claim 15, wherein a second lamina of the laminate construction of each rigid plate is removably attached to the first lamina to capture the at least one elastic band and provide a smooth surface for glide.

17. The compact wallet of claim 16, wherein the second lamina is attached to the first lamina by screws.

18. The compact wallet of claim 1, wherein each rigid plate is comprised of metal for RFID protection.

19. A method of making a modular compact wallet, comprising the steps:

providing at least two rigid plates interposed to sandwich card-like contents there between, each rigid plate having a groove along a longitudinal extent thereof; at least one encircling elastic band slidingly interposed in the grooves to bias the at least two rigid plates inwardly and securely hold the card-like contents while providing elastic volume there between for adding or removing contents, the grooves configured to hold position of the at least one encircling elastic band with respect to each rigid plate while allowing freedom for the dynamic extension and contraction of the band over the entire running length thereof, at least one groove additionally having at least one recess positioned outbound of the elastic band;

providing a first auxiliary feature having at least one tang;

inserting, removably, the at least one tang of the first auxiliary feature into the at least one recess to make the first auxiliary feature available at an outside face of at least one of the two rigid plates;

removing, selectively, the first auxiliary feature;

providing, selectively, at least a second auxiliary feature having at least one tang; and inserting, removably, the at least one tang of the second auxiliary feature into the at least one recess to make the second auxiliary feature available at an outside face of at least one of the two rigid plates, the at least one recess having an undercut operable to engage a hook of the tang to prevent inadvertent dislodgement of the second auxiliary feature from the at least one recess, the hook extending at an angle to the tang, the at least one recess receiving the tang being disposed inside at least one of the two rigid plates;

whereby, card-like contents may be carried with minimal silhouette on or with a person while allowing expandable capacity and ready access to individual contents positioned interiorly to the at least two rigid plates and proving additional functionality from at least one auxiliary feature positioned exteriorly thereto.

20. The method of claim 19, wherein the at least one recess has an undercut and the at least one tang has a hook, the hook and undercut interpositioned to secure the at least one auxiliary feature against inadvertent dislodgement.

21. The method of claim 20, wherein at least one of the auxiliary features is a money clip.

22. The method of claim 19, wherein the groove is in a first lamina of a laminate construction of each rigid plate and the at least one recess is in at least one of the first lamina.

23. The method of claim 22, wherein a second lamina of the laminate construction of each rigid plate captures the at least one elastic band and the at least one tang when removably attached to the first lamina and facilitates placement and removal of the at least one elastic band and the at least one tang when removed from the first lamina.

24. The method of claim 23, wherein the second lamina is attached to the first lamina by screws.

* * * * *